United States Patent [19]

Anderson

[11] 3,964,963

[45] June 22, 1976

[54] APPARATUS FOR PRODUCING CONTINUOUS CAST METALLIC SHEET WITH PATTERNED SURFACE

[75] Inventor: Paul E. Anderson, Torrance, Calif.

[73] Assignee: Martin Marietta Aluminum Inc., Torrance, Calif.

[22] Filed: July 31, 1974

[21] Appl. No.: 493,487

Related U.S. Application Data

[62] Division of Ser. No. 319,033, Dec. 27, 1972, Pat. No. 3,844,336.

[52] U.S. Cl. ..... 164/277; 164/87

[51] Int. Cl.[2] ..... B22D 11/06

[58] Field of Search ..... 164/277, 87; 425/367, 425/369

[56] References Cited

UNITED STATES PATENTS

| | | | |
|---|---|---|---|
| 49,053 | 7/1865 | Bessemer | 164/277 X |
| 1,524,610 | 1/1925 | Ahlgren | 164/277 |
| 1,690,887 | 11/1928 | Davis | 164/277 |
| 3,089,191 | 5/1963 | Conrad | 425/367 X |

FOREIGN PATENTS OR APPLICATIONS

| | | | |
|---|---|---|---|
| 569,390 | 1/1959 | Canada | 164/87 |
| 1,187,865 | 4/1970 | United Kingdom | 164/277 |

*Primary Examiner*—Francis S. Husar
*Assistant Examiner*—John S. Brown
*Attorney, Agent, or Firm*—Millen, Rantes & White

[57] ABSTRACT

A system for continuously casting substantially rigid metallic sheet is disclosed wherein a continuous stream of molten metal is fed into a plenum chamber, the metal directed into the nip between spaced casting members with at least one having recesses in the surface to provide a pattern of spaced projections on at least one side of the sheet. The pressure of the molten metal is only sufficient to cause the metal to fill the major portion of the chamber and the casting members are cooled sufficient to place the solidification point of the molten metal at the projections to cause a progressive laying on of the metal and prevention of the rupture of the formed meniscus adjacent the nozzle orifice. The apex of each recess in the process at the point of laying on is momentarily at a maximum from about 17 to 200 percent greater than the nominal spacing at the nip of the members and the depth of the recess is at least about 5 percent of said nominal spacing but not greater than about 100 percent. Three dimensional (volume) shrinkage of approximately 12 percent occurs in the metal from the point of liquidity to the point of solidification, and consequently an equal (12% minimum) reduction in thickness or squeezing of the metal is selected to offset this phenomenon and thereby produce sheet and projection structure free of cracks, especially in the longitudinal direction. The projections preferably cover between 20 and 50 percent of the total sheet area and are frus-to-conical in shape with sides slanted between 5 degrees and 30 degrees. The projections are formed by progressive laying on and solidification of liquid metal and are free of cross-bands and are between about 5 and 100 percent of the nominal thickness of the sheet.

5 Claims, 9 Drawing Figures

FIG. 1
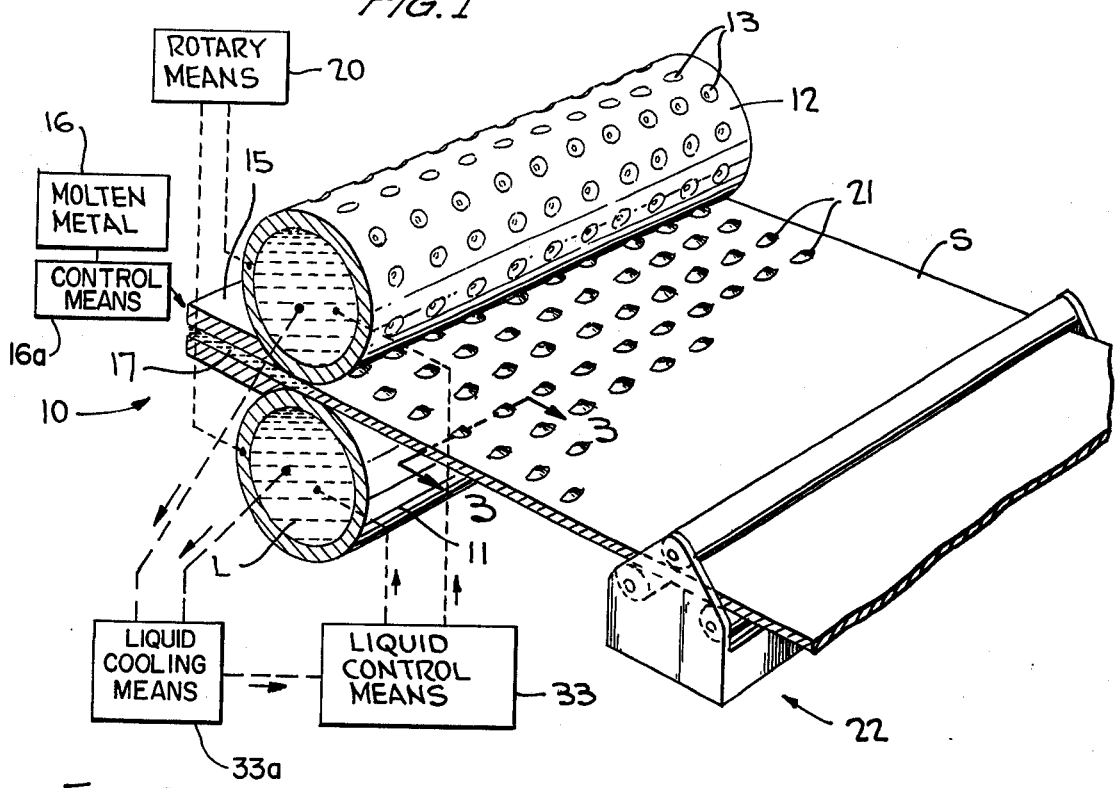
FIG. 2
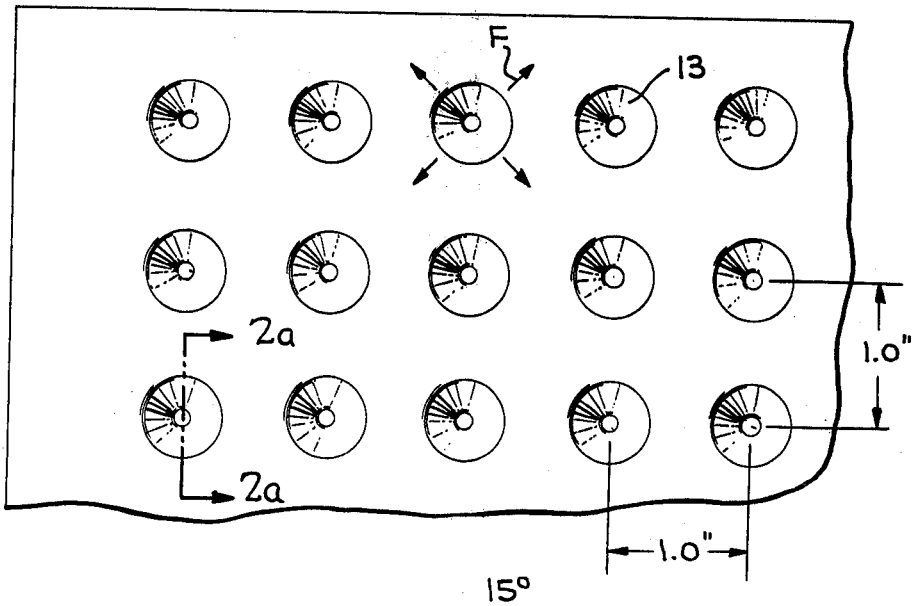
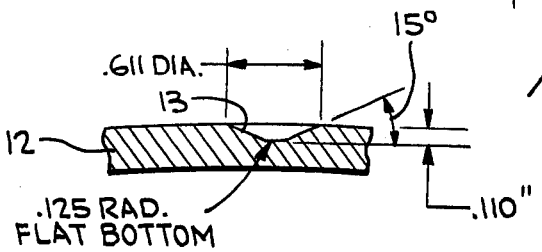
FIG. 2a

APPARATUS FOR PRODUCING CONTINUOUS CAST METALLIC SHEET WITH PATTERNED SURFACE

This application is a divisional application of Ser. No. 319,033, filed Dec. 27, 1972, of Paul E. Anderson for "METHOD OF PRODUCING CONTINUOUS CAST METALLIC SHEET WITH PATTERNED SURFACE," now U.S. Pat. No. 3,844,336, issued Oct. 29, 1974.

The present invention relates to continuous casting, and more particularly, to a system for producing substantially rigid metallic sheet having a pattern of spaced projections that may be both decorative and functional.

BACKGROUND OF THE INVENTION

The art of continuous casting has developed over the past several years so that sheet materials of all widths and thicknesses as well as continuous bars can be made in a highly efficient manner by the process. As is well known in the art, a pair of moving casting members, such as casting rolls, receive a metal bead fed from a nozzle on one side of the nip and by quickly cooling the metal, solidification takes place and a solid sheet or bar emerges on the other side of the nip. After further cooling the product is immediately ready for cutting into lengths or rolling into a roll for storage. Continuous casting has substantially revolutionized the metal industry in terms of cutting the cost of producing metal and in making higher quality stock.

One successful process and apparatus for continuous casting of sheet material is shown in the Harvey et al U.S. Pat. No. 3,405,757, issued Oct. 15, 1968. This patent describes a highly efficient method of casting sheet in continuous form that is free of imperfections, such as defects caused by entrapped gases and crossbanding caused by pulsations in the molten metal entering the nip between the casting rolls. Thus, a sheet with perfectly smooth surfaces and exact cross sectional dimensions is produced by the Harvey et al system. It is from this system that the preferred embodiment of the present invention departs and upon which improvements are made and the disclosure of this of this patent is incorporated in this application by specific reference.

The improvements of the present invention fill a long felt need for economic production of patterned sheets of metal, especially of aluminum alloy, that was not satisfactorily met by prior technology. That is, heretofore, where a pattern of any design was to be placed on the surface of a metal sheet, it had to be performed in a costly separate process step of rolling or embossing. The undue work hardening of the metal resulting from the extra heating that was necessary also tended to weaken the sheet and often resulted in premature failure due to cracking especially when dynamic loads were present. In embossed sheet, the back is not smooth, thus hindering attachment to other surfaces and not affording the increased strength that solid projections afford. In the decorative field, there is a need for substantially rigid sheets with a patterned surface for self-supporting curtain walls, exterior textured walls and integral interior wall paneling. The same sheets have mechanically functional uses as tread plates, metal stairs and machine housing to name a few.

The advance in the art of the present invention over continuous sheet casting procedures, including the Harvey et al patent, resides in the discovery that a sheet may be produced with a pattern of projections or nipples (and adjacent recesses) on at least one surface of the sheet without the difficulties previously considered by the experts to exist. It has been found that a substantially rigid metallic sheet (approximately one-sixteenth to one inch thick or higher) may be cast with projections by use of casting members that have recesses formed in the surfaces thereof, which recesses make the distances between the rolls much greater than previously found to be operable. It has been surprisingly discovered that the sheet may be made a desired nominal thickness with a nozzle designed for this thickness and with the same nozzle the projections that are intermittently presented at the nip between the casting members can be successfully filled with the solidified metal. This has been done without creating the problems of crossbanding, cracking and imperfections and loss of the integrity of the plenum chamber that has previously been held by the experts to foreclose the manufacture of sheets of varying cross section by a continuous casting process. To put it another way, producing a sheet of cross section that varies on a continuous casting machine has previously been rejected out of hand by those skilled in the art since the nozzle is normally closely and precisely related to the specific distance between the rolls just upstream of the nip of the casting rolls. In previous experience, if this distance between the rolls is interrupted so that suddenly a greater distance is provided, the molten metal immediately spilled and the gap between the nozzle and the rolls where the increased distance is provided fills with metal and the continuous casting system had to be shut down.

It has been specifically also discovered, much to the surprise of the experts, that where a pattern of projections is desired the parameters of molten metal temperature and pressure, cooling and speed of the rolls can be controlled so that a meniscus is formed that, in turn, retains the integrity of the molten metal between the nozzle and the surfaces of the casting members or rolls. Also, a gap is preferred between the sides of the nozzle and the rolls since the highly sensitive surface of the rolls is not subject to wear and less power is required to drive the rolls due to the reduction in friction. Furthermore, if molten metal is fed into the plenum chamber at the nip of the rolls in order to fully fill the chamber rather than relying on meniscus control of the bead, then the projections would be formed by rapid movement of the metal into the recesses on the roll as soon as the recess is first uncovered, which causes a disruption of the smooth distribution, resulting in deleterious trapping of gases and even extension of the metal behind the face of the nozzle where harmful sticking is likely.

In the field of thermoplastic continuous sheet forming, there have been successful formations of webs on a patterned roll. This has been possible in such patents as the Fields et al U.S. Pat. No. 3,515,778, issued June 2, 1970 since the cohesiveness of the material is quite different from that of metal. In working with plastic, there is no problem of the material becoming molten or liquid so as to fill the recesses in an uncontrolled manner. The thermoplastic resin will not flow out of the recesses on the patterned roll and thus the problem is not encountered as in metal forming. The U.S. Pat. to Kindseth No. 3,085,292, issued Apr. 16, 1963 shows how thermoplastic resin is self-supporting and thus can be fed onto a patterned roll without concern for free flowing material breaking loose and thus interrupting the continuous forming process.

OBJECTIVES OF THE INVENTION

Thus, it is one object of the present invention to provide a system; including a process and apparatus for continuously casting metallic sheet with a pattern of spaced projections on at least one side without the difficulties previously envisioned.

It is still another object of the present invention to provide a system for continuous metallic sheet casting wherein the molten metal is cooled at a rate that allows casting with intermittent large clearances existing between the casting members adjacent the nozzle thereby allowing formation of a pattern of projections.

It is still another object of the present invention to provide a continuous process wherein the metal in projections on a sheet is solidified such that a progressive laying on of solidfying metal and the retention of a meniscus at the nozzle outlet orifice is maintained.

It is still another object of the present invention to provide a system wherein continuous metallic sheet with projections may be successfully produced with minimum cross-banding and other imperfections which even if they occur are not critical to the end product as they would be in rolled sheet since rolling would likely extend imperfections to cause fracture.

BRIEF DESCRIPTION OF THE INVENTION

With foregoing objectives in mind, it has been discovered that substantially rigid metallic sheet having a pattern of spaced projections may be successfully made in a continuous casting process by providing cooling to the casting member or roll such that a progressive laying on of solidified metal is obtained. This is true even in view of the clearance that exists in the plenum chamber that is substantially larger than previously was anticipated to be allowable under continuous casting conditions, as set forth in the Harvey et al U.S. Pat. No. 3,405,757, mentioned above. Since the relatively large clearances occur only at speed locations, the metal is progressively solidified in the proper manner without rupture of the meniscus that would result in adherence of the sheet of the casting member.

In order to establish the proper solidification point of the molten metal, the metal within the nozzle is provided with pressure only sufficient to cause the metal to fill a major portion of the plenum chamber. It has been found that if more than this pressure is provided the metal does not properly solidify in the recess that form the projections and the surface tension of the meniscus cannot be properly controlled. More specifically, it is found that the cooling is preferably controlled and the apparatus set up so that the members at the apex of each recess at the point of solidification is momentarily at a maximum of from about 17 to 200 percent greater than the nominal spacing at the casting member nip. Also, the depth of each recess is preferably between about 5 –100 percent of the nominal spacing which in effect means that the projection is at least 0.05 to 1 times the nominal thickness of the sheet. Since approximately 12percent shrinkage occurs in metal forming, the distance between opposite points on the casting members is at least 12 percent greater at the laying on point than the same points when they reach the nip. This assures that at the least the shrinkage is just compensated for by the squeezing of the solidifying metal.

The system has been found to provide a metallic sheet that is highly desirable from a decorative standpoint, as well as a functional standpoint, and since the pattern is provided without additional steps the process is highly efficient and economical.

One key to the success of the forming of a sheet with a pattern on at least one side in a continuous casting process is the discovery that the heat transfer away from intermittent projections is sufficient to rapidly cool the increased thickness of molten metal to solidification for smooth, non-stick laying on to the casting roll. The heat is not only directed inward but also laterally toward the raised areas of the casting roll around the projection. The bottom of the recess forming the projection is closer to the interior cooling passage and this also assures the efficiency necessary for maintaining the solidification point at the desired position within the plenum chamber. In short, the heat transfer (and all other important parameters and conditions occurring during the casting process) are controlled to position and maintain the solidification point of the molten metal adjacent the apex of each recess as each comes into position such that a smooth laying process without adherence of metal to the roll is assured.

In carrying out the process, the coverage of the recesses is substantially between 20 and 50 percent of the total surface area of the roll. The projections are formed with side walls sloping at substantially between 5° and 30° by recesses having like formed side walls to prevent abrupt corners and to thus assure against inadvertent rupture of the holding meniscus adjacent the outlet orifice of the nozzle.

The metallic sheet formed by the continuous casting process of the present invention is characterized by the faithful reproduction of the roll contour to produce the projections, since a smooth laying on of solidified metal has occurred during casting. The projections are between 5 and 100 percent of the nominal thickness of the sheet and preferably the apex may be flattened to form frusto-conical projections. Other alternative forms may be pyramids, such as to simulate diamonds, or woodgrain surfaces. The metal is preferably an aluminum alloy and may include a major portion of scrap or recycled aluminum.

Still other objects and advantages of the present invention will become readily apparent to those skilled in this art from the following detailed description, wherein I have shown and described only the preferred embodiment of the invention, simply by way of illustration of the best mode contemplated by me of carrying out my invention. As will be realized, the invention is capable of other and different embodiments, and its several details are capable of modification in various obvious respects, all without departing from the invention. Accordingly, the drawings and description are to be regarded as illustrative in nature, and not as restrictive.

BRIEF DESCRIPTION OF THE DRAWINGS

FIG. 1 is a perspective view showing the casting members as rolls and, in operation, forming a sheet of metal with a pattern of projections;

FIG. 2 is a top plan or layout view of the operative surface of the patterned roll of FIG. 1;

FIG. 2A is a cross sectional view taken along line 2A—2A of FIG. 2 and showing a recess in cross section;

DETAILED DESCRIPTION OF THE PREFERRED EMBODIMENT

Figure 3:
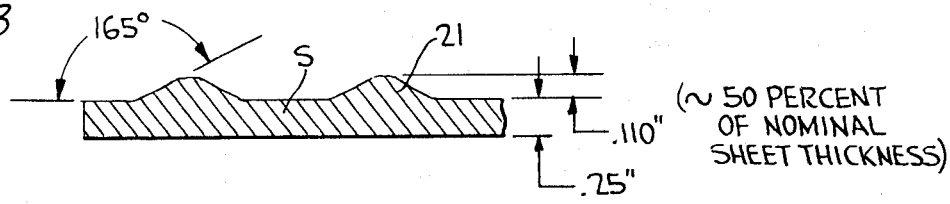
FIG. 3 is a cross sectional view taken through the finished product at line 3—3 of FIG. 1 showing a finished sheet.

With reference now to the drawings and keeping in mind the included reference to the Harvey et al U.S. Pat. No. 3,405,757, mentioned above, there is provided a continuous casting couple, generally designated by the reference numeral 10. The couple 10 preferably comprises a bottom roll 11, having a smooth casting surface and an upper roll 12 having a dimpled casting surface or a surface having a plurality of recesses 13 formed therein in a desired pattern. The rolls 11, 12 are hollow and have cooling liquid L on the inside in a conventional manner. It should be noted that in accordance with the broadest aspects of the present invention other types of continuous casting members could be used and the couple 12 may be positioned at any desired angle or orientation as long as the critical conditions and parameters of the metal are present.

As shown, the rolls 11, 12 are spaced apart to form a gap of desired width, substantially equaling the nominal thickness of sheet S that is produced on the downstream side of the rolls. A nozzle 15 is positioned on the upstream side directed toward the nip, as shown in FIG. 1 and a source of molten metal 16 provides through pressure control means 16*a* the metal through the passageway 17 and the nozzle outlet orifice 17*a* (see FIG. 4). The molten metal source 16 may comprise a melt furnace and holding reservoir, and the pressure control means 16*a* may comprise a float box that maintains the desired pressure by gravity, as set forth in the previous U.S. Pat. No. 3,405,757, incorporated herein by reference. Other well known equivalents for performing the same function could be substituted, as will be recognized by those skilled in this art.

A preferred pattern and shape of the recesses 13 on the surface of the roll 12 is shown in layout form in FIG. 2. In the embodiment shown in these drawings, the recesses are in the form of a frusto cone and are distributed in straight rows and columns. As shown in FIG. 2A, the outer diameter of the recess is or may be 0.611 inches and the spacing between centers (FIG. 2) is typically 1.00 inches. This roughly gives a preferred distribution of the recesses covering approximately 30 percent of the total surface area of the roll. It has been found that this proportion, or more broadly 20 to 50 percent, is highly effective in allowing the proper amount of heat transfer that is critical in maintaining the solidification point of the metal in the recesses 13, as will be seen more in detail later. The bottom of the frusto-conical recess is formed flat with a one-eight inch radius and the depth of the recess is selected to be 0.110 inches. The angle of inclination of the sides of the recess is approximately 15°, or broadly 5° to 30°, also as shown in FIG. 2A.

With the size and distribution of the recesses 13 as described with respect to FIGS. 2 and 2A, the formation of sheet material with projections on one surface is highly efficient. The spacing between the recesses allows highly efficient heat transfer directly inwardly toward the center of the roll 12 where the cooling liquid is located.

It is also believed to be important that the heat transfer is laterally outward away from the recesses 13 to the raised areas surrounding each recess 13 as shown by the flow arrows F in FIG. 2. The outward flow of heat into these areas that receive less direct heat because of the reduced thickness of the sheet S in these areas maintains the required heat transfer capacity from the thicker projections. This in turn assures that the point of solidification is maintained substantially at or just upstream of the point of contact (see FIG. 5 and following operation discussion) so that the metal in molten form does not contact the surface of the roll 12.

Thus, broadly in operation, when molten metal is provided to the nozzle 15 and the rolls 11, 12 are rotated by appropriate rotary means 20, the sheet S of continuous length is produced having a pattern of projections 21 on one surface thereof. The cooling through the liquid L solidifies the advancing metal in a specific manner presently to be described more in detail. The opposite surface is formed smooth through engagement with the conventional smooth surface of the roll 11. A cross sectional view of the sheet S and the raised projections 21 formed in accordance with the preferred embodiment of the present invention is shown in FIG. 3 of the drawings. A support roller assembly 22 may be provided downstream in order to carry the sheet S for further processing of leveling or coiling, as desired.

Figure 4:
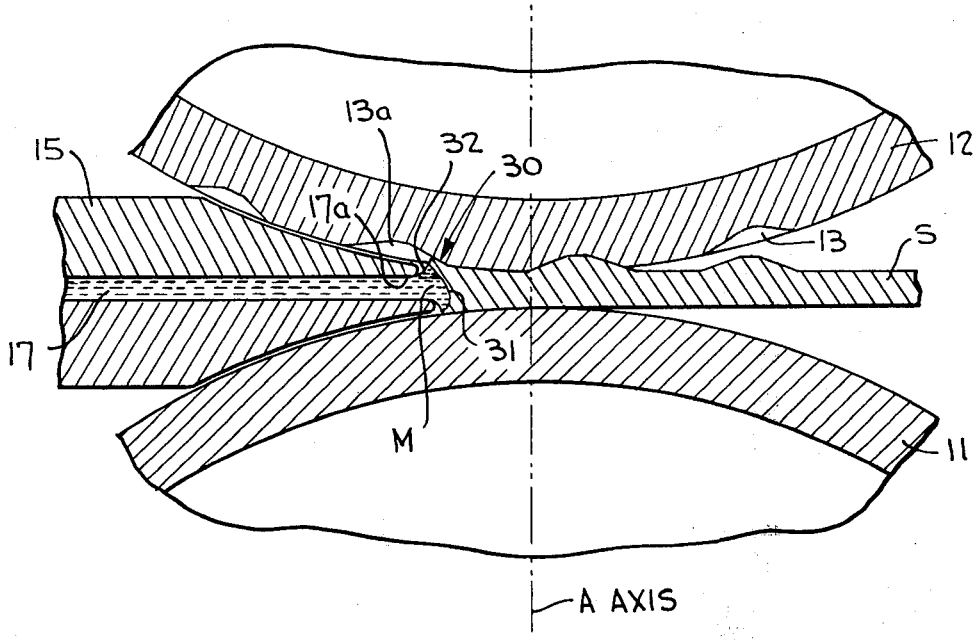
FIG. 4 is a greatly enlarged detail showing the casting rolls forming the continuously cast sheet in accordance with the principles of the present invention.

With reference now to FIG. 4 of the drawings, a more specific explanation of the exact manner in which the improved results of the present invention are obtained will be set forth. In this figure, an enlarged view of the gap between the rolls 11, 12 is shown with the nozzle 15 in cross section showing the feeding of a bead of molten metal M into a plenum chamber, generally designated by the reference indicia 30. In accordance with the invention the pressure from the source 16 of molten metal is adjusted in order to be only sufficient to cause the metal to fill the major portion of the chamber 30. And, most importantly, the cooling liquid L flow from a suitable control means 33 is adjusted so that the molten metal bead solidifies at a point 31 in the plenum chamber 30 across the thickness so that only solidified metal engages the surface of the roll 12, as previously mentioned. The liquid L from the rolls 11, 12 returns to liquid cooling means 33*a* for continuous recycling,. As a set forth in the incorporated reference U.S. Pat. No. 3,405,757, the cooling means may comprise any suitable cooler and the control means may comprise a pump suitably sized to perform the function. Upstream of this point 31 is formed a meniscus 32 having surface tension strong enough to prevent the spilling of the molten metal M back into approaching recess 13*a*, specifically designated in this figure, and/or behind the faces of the nozzle 15 that are in juxtaposition with the surface of the rolls 11, 12.

With the pressure of the molten metal M entering through the nozzle 15 and the cooling properly controlled and the rotation of the rolls 11, 12 controlled at the proper speed, as taught in the prior Harvey et al patent, a sheet S is produced that is free of imperfections. Specifically, cross-banding or layering of the metal and sticking to the roll that would occur should the molten metal M be allowed to spill over into the recess 13a is prevented.

Figure 5:
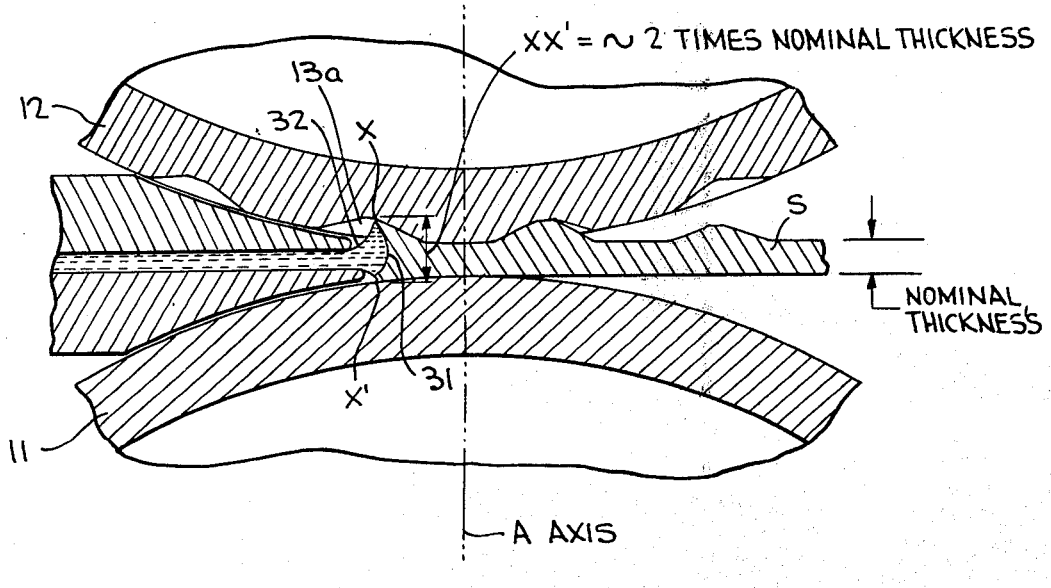
FIG. 5 is an enlarged view like FIG. 4 but with the rolls in a slightly advanced position and the solidification point extending to approximately the apex of the recess.

The desired laying on of solidifying metal into the recess 13a can be seen in detail in FIG. 5. In this figure, it is noted that the distance X, X′ is substantially greater than the nominal thickness of the sheet S, which is in turn, substantially the spacing between the rolls 11, 12. This large clearance between the nozzle 15 and the roll surfaces is what was previously assumed to be an unsatisfactory condition prior to the discovery made in accordance with the present invention. As long as the parameters of molten metal pressure, and the cooling and speed of the rolls 11, 12 is maintained at levels that effectively prevents rupture of the meniscus 32 and assures placement of the solidification point 31 so that metal is solidifying as it contacts the surface of the roll, the patterned sheet S with a minimum of imperfections and cross-banding is provided. The rolls 11, 12 may be tilted on an axis A spaced from the vertical, substantially as shown in the Harvey et al patent, mentioned above. However, it is to be understood that other positionings of the roll are feasible and are within the purview of the present invention so long as the conditions set forth above are met.

It has been found that the distance X, X′ should preferably be about 0.17 to 2 times greater than the nominal thickness of the sheet S, i.e., about 17 to 200 percent greater than the spacing between the casting rolls 11, 12. Within this range, the meniscus 32 is maintained without breakage and the laying on of the solidified metal can take place at the points X, X′. More particularly, the range may be narrowed to 80–120 percent, and specifically to 100 percent (see product of FIG. 5) for best results. The depth of the recesses 13 are preferably between 5 and 100 percent of the nominal thickness of the sheet S in order to successfully produce a sheet with the most desirable proportions. The completed projections also cooperate with their mating recess to minimize surging or drawing of the sheet as it narrows down to its nominal thickness in the nip.

It can be seen with clarity in FIG. 5 how those skilled in the art were mislead prior to my discovery. The meniscus 32 may be stretched to a limit heretofore believed impossible, whereupon X, X′ is even up to as much as two times greater than the nominal thickness of the sheet S. The cooling of the increased thickness of metal X, X′ that is necessary is believed to be possible for one reason because of the limited extent of the projections 21 across the width of the sheet. Also, the relatively short duration during which the meniscus 32 is extended its full amount (FIG. 5 showing) prevents its rupture; it being understood that the continued rotation of the rolls from the position of FIG. 5 causes an immediate reduction of the gap until the bead of the molten metal M is again reduced to its nominal thickness.

From the showing in FIGS. 4 and 5, it can also clearly be seen how the injection of molten metal M without the control of the meniscus 32 to form a defined bead would allow premature entry of the metal into the next in-line recess 13a each time. With uncontrolled molten metal spilled into the area above the upper surface of the nozzle, not only would there be created an imperfection and cross-banding in the projections 21 that would be unacceptable in a finished product, but also obviously, a costly shut down of the process and a restart would be required.

The separation at the initial solidification or liquidus-solid transformation line across bead M, substantially at points X, X′ in FIG. 5, is at least 12 percent greater than the same points when they reach the nip. This is important since it means that the approximate 12 percent shrinkage can be accommodated by the squeezing or rolling action of the couple 10 on the solidifying metal in the nip. In other words, the minimum reduction in the gap at any point is just sufficient to accommodate the expected shrinkage. This assures that there are no cracks formed, particularly in the longitudinal direction of the sheet S due to holding of the edges by the solidifying projections 21 seated in the recesses 13.

The finished product or sheet S can be used as decorative metal plate or sheet directly from the casting operation without the need for further conventional rolling or embossing whereby the substantial reduced production cost factor is gained. The product with the pattern of frusto-conical projections 21 on the surface shown in FIG. 3 is decorative and can be used for this function in the form of wall panels or the like.

Figure 6:
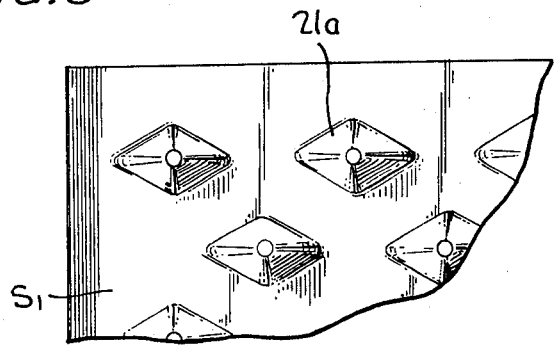
FIG. 6 is a partial plan view of a finished sheet showing an alternative form and pattern that may be adopted for the projections.
Figure 6A:
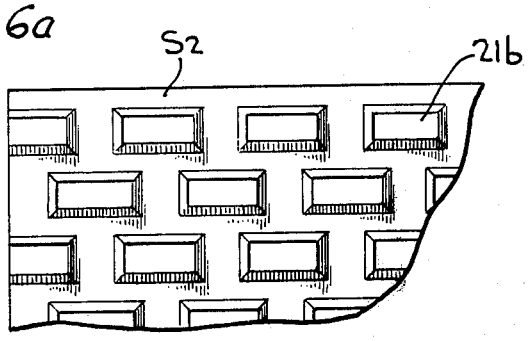
FIG. 6A is another showing of flat sheet having a different shape and layout of projections.
Figure 6B:
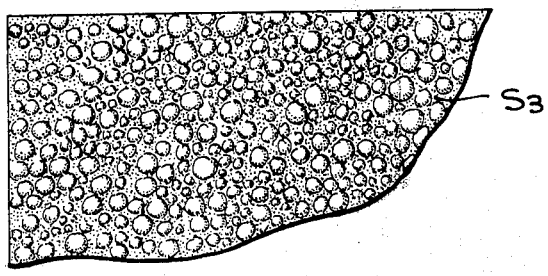
FIG. 6B is still another showing of flat sheet having projections but in a typical random pattern.

Alternative sheet designs $S_1$ and $S_2$ are shown in FIGS. 6 and 6A. In FIG. 6, projections 21a are positioned on the surface of the sheet $S_1$ and are in the form of diamond shaped pyramids also with the side walls sloping at substantially between 5°–30°, as desired. In FIG. 6A, the pyramids may be made rectangular and thus projections 21b are provided. The top of the pyramid covers a major portion of the projections and with elongated recessed areas between the projections **21*b*, a panel having a decorative surface resembling a brick structure is realized. A third possible alternative is a random or patterned design, that may resemble a stucco or plastered surface; the former being exemplified as surface $S_3$ in FIG. 6B.** Other patterned or textured designs wherein there are alternate raised and recessed portions are envisioned under the broadest aspects of the present invention, as previously mentioned and as will be readily understood.

The projections **21, 21*a*, 21*b* or others while being highly decorative and thus useful for that function, may also be functional in a mechanical sense, such as for tread plate for walkways or stairs. As is well known, the tops of the projections 21, 21*a*, 21*b*** can afford a limited area of engagement for the feet of a person walking on the tread, thus greatly increasing the unit force and thereby the effective frictional engagement. In addition, liquids that happen to be on the tread surface will remain free of the operative engagement areas, thus obviating a possible hazard. The solid, non-embossed structure of the cast sheet S makes the structure particularly strong and thus adapted for such use.

The precise control of the cooling rate by the liquid L and the speed of the rolls 11, 12 by the rotary means 20 can be generally controlled in accordance with the data set forth in the Harvey et al patent, mentioned above. Specific experimentation has been carried out with a machine of the type shown in the Harvey et al patent wherein a continuous sheet approximately 52 inches wide and with a nominal thickness of approximately one-quarter inch (see FIG. 3) has been produced. The resultant product was substantially free of cross-banding, longitudinal cracks and other imperfections, notably in the area of the projections 21. The aluminum alloy had the following percentages of metals:

| Al | Si | Fe | Cu | Mn | Mg | Cr | Ni | Zn | Ti |
|---|---|---|---|---|---|---|---|---|---|
| 98.01 | .16 | .51 | .31 | .32 | .61 | .02 | — | .03 | .03 |

During the test run while producing the quarter inch thick continuous sheet the molten metal was supplied at approximately 1280° Farenheit. The pressure head within the passageway 17 of the nozzle 15 was 7/16 inch and the casting roll speed was 24 inches per minute.

From the foregoing, it can be seen that a cast metal sheet that is substantially rigid can be made with a textured or patterned surface in a highly efficient manner. Whereas before the sheet would have to be cast first and then reheated and rolled or embossed, the final product can now be more efficiently made in a single step process. The process is carried out and the apparatus is constructed so as to properly place the solidification point of the molten metal for a laying on of the metal so that the molten or non-solidifying metal does not enter the recesses 13. Thus, spill over of molten metal that results in imperfections and sticking of the sheet S to the roll is effectively avoided. The apex of each recess 13 at the point of laying on of the solidified metal adjacent the outlet orifice of the nozzle 15 is momentarily at a maximum from about 17 to 200 percent greater than the nominal spacing between the rolls 11, 12 at the nip. At least a 12 percent reduction or squeeze is placed on the sheet S between the initial solidification point and the nip to offset metal shrinkage effect. The depth of the recess 13 is between about 5 and 100 percent of the nominal thickness of the sheet S in order to provide a suitably decorative or functional patterned surface.

In this disclosure, there is shown and described only the preferred embodiment of the invention, but, as aforementioned, it is to be understood that the invention is capable of use in various other combinations and environment and is capable of changes or modifications within the scope of the inventive concept as expressed herein.

I claim:

1. Apparatus for use in continuous casting from molten metal of substantially rigid metallic sheets having a pattern of spaced projections on at least one side, comprising in combination a pair of oppositely rotatable rolls set generally one above the other and spaced to provide a longitudinal nip therebetween, the surface of the upper roll having laterally and circumferentially spaced recesses thereon, said recesses having a depth between 5 to 100 percent of the nominal spacing at the nip between said rolls, a nozzle positioned on the upstream side of said rolls for feeding molten metal into a plenum chamber formed between the nozzle and the rolls, said nozzle having its outlet directed toward said nip between the rolls, means to supply molten metal through said nozzle under controlled pressure, said nozzle outlet from which molten metal enters said plenum chamber being located shortly upstream of that location in the plenum chamber where the spacing between the apex of each recess in the rotating upper roll and the surface of the lower roll momentarily becomes from 17 percent to 200 percent greater than the nominal spacing between the rolls at the nip therebetween, means to rotate said rolls at controlled speed of rotation, means to provide a cooling liquid to the interior of said rolls and means to control the cooling liquid flow to maintain the desired cooling rate.

2. The apparatus of claim 1, wherein the recesses on said upper roll cover substantially between 20 and 50 percent of the surface of said roll.

3. The apparatus of claim 1, wherein the recesses on said upper roll are formed at least partially conical in shape with side walls sloping at substantially between 5° and 30° with respect to the surface of said upper roll.

4. The apparatus of claim 3 wherein the apex of each recess is flattened to form a corresponding frusto-conical projection.

5. The apparatus of claim 1 wherein the nozzle outlet directly opens into said plenum chamber upstream of that location in the plenum chamber where the spacing between the apex of each recess in the rotating upper roll and the surface of the lower roll momentarily becomes from 80 percent to 120 percent greater than the nominal spacing between the rolls at the nip therebetween.

* * * * *